US005947028A

United States Patent [19]

Montgomery et al.

[11] Patent Number: 5,947,028

[45] Date of Patent: Sep. 7, 1999

[54] METHOD AND APPARATUS FOR HOLDING A PRINTING PLATE ON A VACUUM DRUM

[75] Inventors: Darcy T. Montgomery, Burnaby; David P. Pires, Vancouver, both of Canada

[73] Assignee: Creo Products Inc., Burnaby, Canada

[21] Appl. No.: 09/076,171

[22] Filed: May 7, 1998

[51] Int. Cl.[6] ..... B41F 1/28

[52] U.S. Cl. ..... 101/477; 101/389.1

[58] Field of Search ..... 101/415.1, 389.1, 101/477

[56] References Cited

U.S. PATENT DOCUMENTS

| | | | |
|---|---|---|---|
| 3,304,757 | 2/1967 | Achler et al. | 72/166 |
| 3,937,052 | 2/1976 | Hoexter et al. | 72/166 |
| 4,766,811 | 8/1988 | Linska | 101/415.1 |
| 5,090,685 | 2/1992 | Danon et al. | 271/276 |
| 5,406,888 | 4/1995 | Sugiyama et al. | 101/415.1 |
| 5,699,740 | 12/1997 | Gelbart | 101/477 |

*Primary Examiner*—Edgar Burr
*Assistant Examiner*—Dave A. Ghatt
*Attorney, Agent, or Firm*—Oyen Wiggs Green & Mutala

[57] ABSTRACT

The holding of metal printing plates on a rotating drum using vacuum is greatly improved by bending at least one edge of the plate with a curvature approximately matching the drum curvature. Plate can be bent back to flat shape after unloading.

23 Claims, 1 Drawing Sheet

METHOD AND APPARATUS FOR HOLDING A PRINTING PLATE ON A VACUUM DRUM

FIELD OF INVENTION

The invention relates to printing, and in particular, to the loading of metal lithographic printing plates onto a drum, or a cylinder, where they are held in place by the force of vacuum. The invention can be used on Computer-to-Plate or Computer-to-Press systems, also known as On-Press Imaging.

BACKGROUND ON THE INVENTION

Traditional imagesetters used in the pre-press area of a printing operation use vacuum to hold films to a rotating drum while exposing them using a laser. In order to image directly on lithographic printing plates both in Computer-to-Plate and Computer-to-Press systems, a method of holding metal plates to the outside surface of a rotating drum, or cylinder, is desired. Due to the higher stiffness and thickness of metal printing plate the force of the vacuum, limited to atmospheric pressure, is insufficient to reliably hold a metal plate onto a drum, in particular a rotating drum. Prior art solutions involve clamps (both mechanical and magnetic) as well as using steel plates on magnetic drums. Since most lithographic printing plates are made of aluminum and are non-magnetic it is desired to have a system holding the plate without clamps and without relying on magnetic properties. The plate can be imaged on the drum (as done in Computer-to-Plate and Computer-to-Press) or pre-imaged and mounted later on the plate cylinder of a printing press. In the latter applications using vacuum instead of clamps allows nearly gapless plate mounting and simplified automatic loading of plates. The invention can also be used to load thin metal backed flexographic plates onto a press and other metal backed plates. The invention is also useful when clamps are used, as it reduces the force required to hold the plate. Any combination of clamps and vacuum is improved by the invention.

SUMMARY OF THE INVENTION

The invention relies on the fact that the thin sheets of metal used as substrate for printing plates can be given a permanent curl to fit the form of the drum. If the plates were to be pre-curled it would cause handling problem particularly during plate processing. Prior art, such as U.S. Pat. No. 5,679,740 (assigned to the same assignee as current application) imparts a curl to the whole plate in order to fit it around the drum. It has been found that it is sufficient to curl just the edge of the plate in order to achieve good holding of the plate to the rotating drum, when the plate is held on by evacuating the drum. Either both leading and trailing edges are curled or one of the edges is held by a fixed mechanical device and the other edge is curled. In order to be able to load different plate sizes without any mechanical adjustments, a mechanical clamp can only be used at one edge of the plate. Since only the edge requires a curl, rollers are no longer required and a simpler system, similar to a press brake or a bender can be used.

DESCRIPTION OF THE PREFERRED EMBODIMENT

Figure 1A:
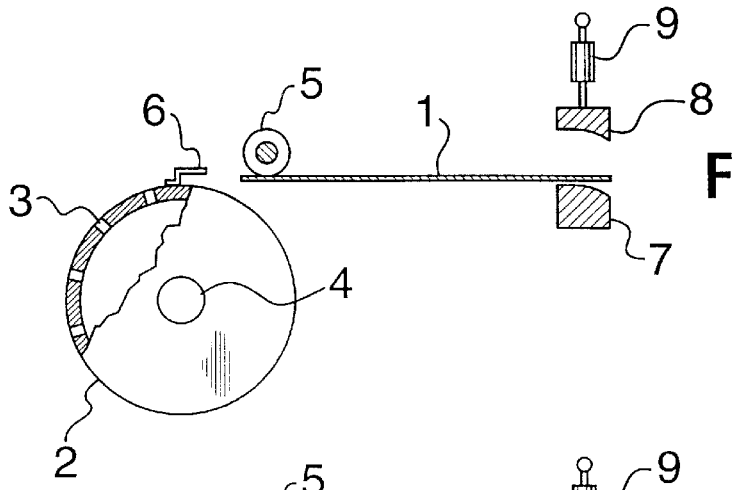
FIG. 1-*a* to FIG. 1-*d* shows a cross section of the invention and the steps required to load, hold and unload a plate according to the invention.
Figure 1B:
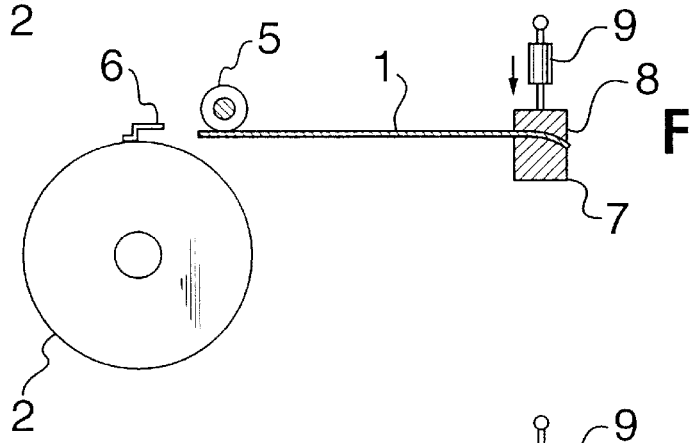
Figure 1C:
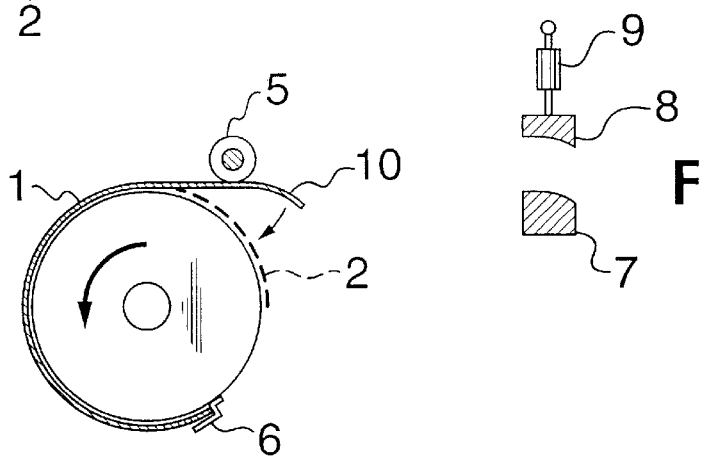
Figure 1D:
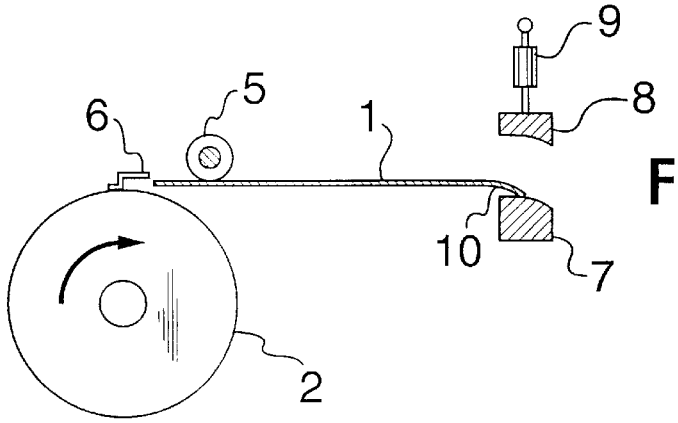

Referring now to FIG. 1-*a*, a metal printing plate 1 is loaded onto a vacuum drum 2. Drum 2 has vacuum holes 3 and is kept evacuated via port 4. The leading edge of plate 1 is guided into a mechanical retainer 6 which prevents it from lifting off as the drum spins. Mechanical retainer 6 can be an active clamp or simply a slot into which plate 1 is inserted. A stationary die 7 and a moveable die 8 are provided for bending the trailing edge of plate 1. Referring now to FIG. 1-*b*, the moveable die 8 is moved by actuator 9 in order to bend the trailing edge of plate 1 with a curvature approximately matching the curvature of drum 1. The bent area can be quite narrow, in the range of 10–50 mm. Actuator 9 can be a pneumatic cylinder or an electromechanical device. After bending, plate is rolled onto drum as shown in FIG. 1-*c*. Guide roller 5 brings the bent edge 10 of plate 1 sufficiently close to drum 2 to be held by the atmospheric pressure, acting against the vacuum inside drum. If mechanical retainer 6 is not desired (for example if drum 1 is the plate cylinder of a printing press) bending dies 7 and 8 are shaped to bend both the leading and trailing edge of the plate 1. After plate is imaged it is being unloaded as shown in FIG. 1-*d*. The part of dies 7 and 8 facing drum 2 is flat, in order to flatten the curled edge 10 of plate 1. For plates made of more elastic material, such as steel, a reverse curl is required on dies 7 and 8 to render the plate flat. After edge 10 is flattened plate 1 reverts to its original flat shape. Using this invention aluminum printing plates as thick as 0.4 mm (0.016") were held to a drum having a diameter of 300 mm (12") at speeds up to 1000 RPM, using a vacuum of 80% of full vacuum. Without bending the edge it was not possible to hold the same plate to the same drum even at full vacuum. The same method can be used to assist in fitting a plate to the inside of a drum. This is useful in a type of image recorders known as "internal drum" type. Without this invention the edges of the plate stay flat and resist following the internal curvature of the drum. In internal drum systems vacuum is not always required, as plate can be held in place by compression applied at the edges of the plate.

The preferred embodiment uses only vacuum to hold the plates, however the present invention reduces the required holding force regardless of the hold-down method. It can be used in conjunction with vacuum, mechanical clamps, magnetic clamps or any combination of the above. Either or both of the leading edge and trailing edge of plate 1 may be curled. If only one edge is curled then the other edge is held by a mechanical device. If only one edge is curled then the curled edge may be called a "first edge" and the non-curled edge may be called a "second edge". If both the leading and trailing edges of plate 1 are curled then one of the curled edges may be called a "first edge" and the other one of the curled edges may be called a "second edge".

What is claimed is:

1. A method for loading a generally planar printing plate onto a drum, the method comprising:

(a) providing a cylindrical drum having a curvature and a generally planar plate, the plate comprising a first edge, a second edge, and a central portion therebetween;

(b) imparting a retained curvature to a first edge of the plate, the retained curvature approximately equal to the curvature of the drum while keeping a central portion of the plate flat; and, (c) wrapping the flat central portion around the drum until the first edge is in contact with the drum.

2. The method of claim 1 wherein imparting a retained curvature to the first edge of the plate comprises placing the first edge of the plate between first and second curved dies and compressing the plate between the dies.

3. The method of claim 1 wherein wrapping the flat central portion around the drum until the first edge is in contact with the drum comprises holding a second edge of the plate to the drum.

4. The method of claim 3 wherein holding the second edge of the plate on the drum comprises placing the second edge of the plate under a mechanical retainer on the drum.

5. The method of claim 3 comprising at least partially removing the plate from the drum and subsequently flattening the first edge of the plate by compressing the first edge of the plate between a pair of dies to cancel the retained curvature of the first edge of the plate.

6. The method of claim 5 wherein the dies each have a mating flat part and a mating curved part wherein imparting a retained curvature to the first edge of the plate comprises compressing the plate between the dies with the first edge of the plate between the mating curved parts of the dies and flattening the first edge of the plate comprises compressing the plate between the dies with the first edge of the plate between the mating flat parts of the dies.

7. The method of claim 5 wherein the dies each have a mating reverse curve part and a mating curved part wherein imparting a retained curvature to the first edge of the plate comprises compressing the plate between the dies with the first edge of the plate between the mating curved parts of the dies and flattening the first edge of the plate comprises compressing the plate between the dies with the first edge of the plate between the mating reverse curve parts of the dies.

8. The method of claim 5 wherein holding the second edge of the plate on the drum comprises placing the second edge of the plate under a mechanical retainer on the drum.

9. The method of claim 1 wherein the drum is partially evacuated and the plate is held to the drum by a pressure differential across the plate.

10. The method of claim 9 comprising imparting a retained curvature to each of the first and second edges of the plate so that the first and second edges of the plate each have a retained curvature approximately equal to the curvature of the drum while keeping a central portion of the plate flat.

11. The method of claim 10 comprising holding the second edge of the plate on the drum while wrapping the flat central portion around the drum.

12. The method of claim 11 wherein holding the second edge of the plate on the drum comprises providing a pressure differential across the second edge of the plate by partially evacuating the drum.

13. The method of claim 1 wherein the curved first edge of the plate has a width in the range of 10 mm to 50 mm.

14. A method for loading a transversely flexible printing plate onto a drum, the method comprising:

(a) a step for bending a first edge of a substantially flat plate, the plate comprising the first edge, a second edge, and a central portion therebetween, to provide the first edge of the plate with a retained curvature having a radius approximately equal to a radius of a cylindrical drum while keeping the central portion of the plate substantially flat; and, (b) a step for wrapping the central portion of the plate around the cylindrical drum until the first edge is in contact with the curved surface of the drum, the central portion remaining substantially flat until it is wrapped onto the drum.

15. The method of claim 14 comprising a step for holding a second edge of the plate on a curved surface of the cylindrical drum while wrapping the central portion of the plate around the cylindrical drum.

16. The method of claim 15 comprising maintaining a reduced pressure within the drum and allowing atmospheric pressure to press portions of the plate in contact with the curved surface against the curved surface.

17. The method of claim 15 wherein wrapping the central portion of the plate around the cylindrical drum comprises rotating the drum so that the central portion of the plate is drawn between the curved surface and a guide roller.

18. The method of claim 14 wherein the step for bending a first edge of a substantially flat plate comprises compressing the first edge of the plate between a pair of dies.

19. The method of claim 14 comprising a step for unwrapping the plate from the drum and a step for flattening the first edge of the plate after the plate has been at least partially removed from the drum.

20. The method of claim 19 wherein the step for bending a first edge of a substantially flat plate comprises compressing the first edge of the plate between a pair of curved dies and the step for flattening the first edge of the plate comprises compressing the first edge of the plate between a pair of dies.

21. A method for loading a generally planar printing plate onto a cylindrical surface having a curvature, the method comprising:

(a) providing a generally planar plate having a first edge, a second edge, and a central portion therebetween;

(b) forming a retained curve having a curvature approximately equal to the curvature of the cylindrical surface in the first edge of the plate while keeping the central portion of the plate flat;

(c) after providing the generally planar plate, bringing the flat central portion into contact with the cylindrical surface and thereby imparting a non-retained curve to the flat central portion so that the central portion follows the curvature of the cylindrical surface; and, (d) holding the first and second edges of the plate in contact with the cylindrical surface.

22. The method of claim 21 comprising maintaining a reduced pressure behind the cylindrical surface and allowing atmospheric pressure to press portions of the plate in contact with the cylindrical surface against the cylindrical surface.

23. The method of claim 21 wherein the cylindrical surface is an internal surface of a cylindrical drum.

* * * * *